US005333359A

United States Patent [19]

Kroupa

[11] Patent Number: 5,333,359

[45] Date of Patent: Aug. 2, 1994

[54] NON-CIRCULAR SLIVER CONTAINER

[75] Inventor: Petr Kroupa, Liberec, Czechoslovakia

[73] Assignee: Elitex Ûstí nad Orlicí Ûstí nad Orlicí, Czechoslovakia

[21] Appl. No.: 947,525

[22] Filed: Sep. 18, 1992

[30] Foreign Application Priority Data

Sep. 23, 1991 [CS] Czechoslovakia ..... 2895-91

[51] Int. Cl.[5] ..... D04H 11/00

[52] U.S. Cl. ..... 19/159 R; 57/281; 206/388

[58] Field of Search ..... 19/159 R, 159 A; 57/90, 57/281; 220/751, 755, 760, 23.4; 206/388

[56] References Cited

U.S. PATENT DOCUMENTS

| | | | |
|---|---|---|---|
| 2,470,432 | 5/1949 | Cusick | 220/23.4 |
| 3,116,517 | 1/1964 | Perry | 19/159 R |
| 4,653,263 | 3/1987 | Stahlecker et al. | 57/281 |
| 4,932,201 | 6/1990 | Meroni et al. | 57/281 |
| 4,977,738 | 12/1990 | Stahlecker | 57/281 |

FOREIGN PATENT DOCUMENTS

| | | | |
|---|---|---|---|
| 344484 | 12/1989 | European Pat. Off. | 19/159 R |
| 4018088 | 1/1991 | Fed. Rep. of Germany | 57/281 |
| 4015938 | 11/1991 | Fed. Rep. of Germany | 57/281 |
| 15102 | of 1913 | United Kingdom | 220/751 |
| 1072 | of 1915 | United Kingdom | 19/159 A |
| 374393 | 6/1932 | United Kingdom | 19/159 R |

*Primary Examiner*—Clifford D. Crowder
*Assistant Examiner*—Michael A. Neas
*Attorney, Agent, or Firm*—Notaro & Michalos

[57] ABSTRACT

A non-circular sliver container (1) is used for transporting sliver (2) to a spinning machine having a support table (3) fixed to one of its rounded ends at its upper edge. A groove (31) for receiving a reinforced introducing point (4) of the sliver (2) is provided. A recess (32) is provided in the groove (31) for allowing the point (4) of the sliver (2) to be gripped and inserted int a spinning machine.

1 Claim, 1 Drawing Sheet

NON-CIRCULAR SLIVER CONTAINER

FIELD AND BACKGROUND OF THE INVENTION

Field of Art

The present invention relates to a non-circular sliver container.

Containers for receiving and transporting sliver shaped as circular cylinders, known as textile cans, into which the sliver is deposited by a coiler of a sliver producing machine are commonly found in the textile field. Other known modifications of textile cans consist of a sliver end holder located on the can and adapted to grasp a non-adapted end of the sliver at a predetermined location along the circumference of the can in such a manner that the sliver end hangs vertically for sliver processing.

Drawbacks of the known devices exist in that they are not very suitable for automated processes for can exchange and sliver insertion into a spinning unit. Also, these devices do not utilize the space afforded under rotor spinning machines.

SUMMARY OF THE INVENTION

The listed above drawbacks are eliminated by a non-circular or oval sliver container according to the present invention. The present invention provides that on one of its shorter sides, i.e., at the elliptical-shaped ends, a support table is firmly fixed and situated under the upper edge of the container. The support table has a groove made thereon for depositing a reinforced introducing point of the sliver. A recess is also provided in the support table.

In a preferred embodiment, the non-circular sliver container carries on one of its shorter sides, above its lower edge, a suspension eye, preferably seated at the same side with the support table.

The side walls of the suspension eye can be bevelled at an acute angle.

The non-circular container according to the present invention provides for automatic handling of the container and of the sliver end.

DESCRIPTION OF THE PREFERRED EMBODIMENTS

Figure 1:
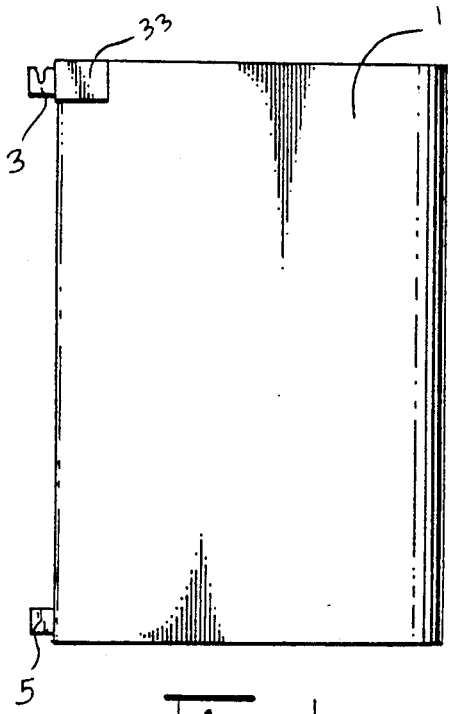
FIG. 1 is an elevational side view of the container according to the present invention.
Figure 2:
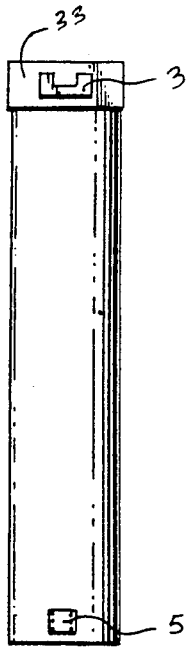
FIG. 2 is an elevational side view of the non-circular container of FIG. 1.
Figure 3:
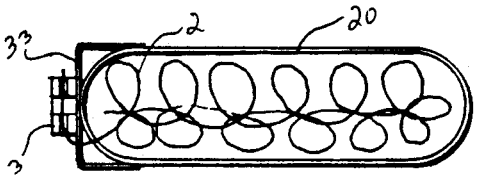
FIG. 3 is a top plan view of the non-circular container of FIG. 1.

FIGS. 1-3 illustrate that the present invention comprises a non-circular container or oval container 1 for holding sliver 2 having an elongated sides 20, and is adapted for making efficient use of the space available under a rotor spinning machine The non-circular containers 1 are arranged under spinning stations, in a known manner adjacent to each other in a row, with one sliver container 1 related to each spinning station.

The non-circular container 1 consists of a hollow body with elongated, straight sides 20 and rounded ends 22 in the front and rear sections of the non-circular container 1. The sides 20; of the non-circular sliver container 1 are made in sheets, i.e., sheet metal and the inner hollow space of the container 1 allows for sliver 2 to be deposited therein.

Figure 5:
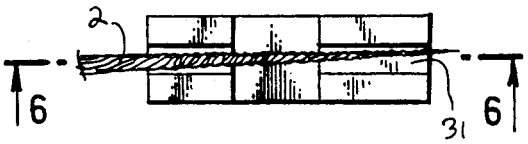
FIG. 5 is a top plan view of a support table according to the present.
Figure 4:
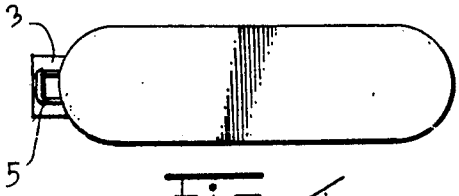
FIG. 4 is a bottom plan view of the non-circular container of FIG. 1.
Figure 6:
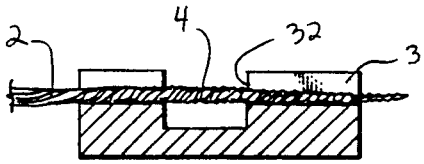
FIG. 6 is a cross-sectional side view of the support table of FIG. 5.

On the upper part of the front side of the non-circular container 1, a fixed support table 3 is provided and secured to the container 1 by a bracket 33 for receiving a reinforced introducing point 4 of a sliver 2, as shown in FIG. 5. A suspension eye 5 is provided on the lower section of the container 1 at a rounded end 22 for moving purposes as shown by FIG. 4.

Provided in the support table 3 is a groove 31, preferably parallel with the rounded end 22 of the non-circular sliver container 1, perpendicular to the elongated sides 20 of the container 1. Also provided in the support table in its upper part, is a recess 32, which is deeper than the groove 31 and preferably perpendicular to it, and intersecting the groove 31.

Figure 7:
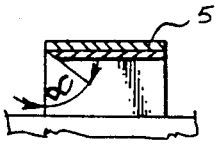
FIG. 7 is a side-view of the suspension eye.
Figure 8:
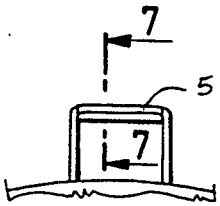
FIG. 8 is a bottom plan view of the suspension eye of FIG. 7.

FIGS. 7 and 8, illustrate that the suspension eye 5 is a rectange or a square, with an inner side of at least its front wall 51 bevelled at an acute angle $\alpha$.

In a well-known manner, the non-circular sliver container 1 is filled with sliver 2 at a sliver producing machine such as a carding or drawing machine, and then moved to device and another container 1 is moved into position for filling with sliver 2. The sliver 2 between the container 1 already filled with sliver 2 and a container 1 currently being filled with sliver 2 is interrupted by cutting the sliver between the containers 1. Also, in a well-known manner, the end of the sliver 2 of the full non-circular sliver container 1, is transformed into the reinforced introducing point 4, for instance by wetting in water, drilling, and squeezing. The reinforced introducing point 4 is then freely laid into the groove 31 of the support table 3.

The recess 32 of the support table 3 permits the gripping of the reinforced introducing point 4 by a handling means of a sliver processing machine, e.g., of a rotor spinning machine, and to introduce it into the feed mechanism of the spinning station.

The suspension eye 5 helps to move the container 1 by a transport means such as transport car. The transport car being fitted with a handling mechanism comprising bars having hooks for engaging the suspension eye 5.

The handling of the non-circular 1 can be carried out in many ways with or without the suspension eye 5 of the non-circular sliver containers 1.

The non-circular sliver container 1 can be used advantageously in automated or mechanized spinning mills.

I claim:

1. A container for deposition and transport of a sliver, the container comprising:

a pair of elongated side walls;

a pair of front walls connected to the elongated side walls, the side walls and the front walls defining a space for depositing the sliver, and at a top of the side walls and the front walls defining an upper rim;

a bottom situated between the side walls and the front walls below the space; and a support table fixed to one of the front walls below the upper rim at an outer side of the front wall, the support table having a groove thereon, the groove substantially parallel with a plane of the upper rim, the support table having a recess intersecting with the groove and the recess being deeper than the groove.

* * * * *